US006461186B1

(12) United States Patent
Endo

(10) Patent No.: US 6,461,186 B1
(45) Date of Patent: Oct. 8, 2002

(54) CONNECTOR WITH LOCK ENSURING MECHANISM

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/955,337

(22) Filed: Sep. 19, 2001

(30) Foreign Application Priority Data

Sep. 22, 2000 (JP) ..... 2000-289136

(51) Int. Cl.[7] ..... H01R 13/62
(52) U.S. Cl. ..... 439/352; 439/489
(58) Field of Search ..... 439/352, 489, 439/350, 351, 353–358

(56) References Cited

U.S. PATENT DOCUMENTS 5,803,651 A * 9/1998 Saito ..... 439/352
5,910,027 A * 6/1999 Wayt et al. ..... 439/352
5,947,763 A * 9/1999 Alaksin ..... 439/489
6,109,955 A * 8/2000 Hanazaki et al. ..... 439/489
6,126,480 A * 10/2000 Kawase et al. ..... 439/352

FOREIGN PATENT DOCUMENTS

| | | |
|---|---|---|
| EP | 0 655 807 | 5/1995 |
| JP | 9-219255 | 8/1997 |

* cited by examiner

*Primary Examiner*—Gary F. Paumen
(74) *Attorney, Agent, or Firm*—Armstrong, Westerman & Hattori, LLP

(57) ABSTRACT

A connector 1 provided with a lock ensuring mechanism includes a female housing 2, a male housing 3, and a lock ensuring member 4. The female housing 2 is provided with a lock hole 5. The male housing 3 is provided with a lock arm 16 having a lock projection 36 which is adapted to be engaged with the lock hole 5. The lock ensuring member 4 is movably supported by the male housing 3. The lock ensuring member 4 has a flexible piece 31 which is in contact with the lock projection 36 in a state where the lock projection 36 is not engaged with the lock hole 5. When the lock projection 36 has come into engagement with the lock hole 5, the flexible piece 31 is detached from the lock projection 36. In this manner, an incompletely engaged state of the housings with each other can be reliably detected.

3 Claims, 6 Drawing Sheets

CONNECTOR WITH LOCK ENSURING MECHANISM

FIELD OF THE INVENTION

The present invention relates to a connector with a lock ensuring mechanism to be used for connecting electric wires.

DESCRIPTION OF THE RELATED ART

A wire harness to be employed in an automobile as a moving body includes a connector which can be obtained by coupling a male type connector housing (hereinafter referred to as "a male housing") and a female type connector housing (hereinafter referred to as "a female housing"). The male housing and the female housing respectively receive metal terminals provided with electric wires.

In the connector in which the male housing and the female housing are connected with each other, there have been heretofore proposed various types of lock ensuring mechanisms in order to confirm whether the male housing and the female housing have been completely connected with each other or in an incompletely engaged state.

The connector having the above described lock ensuring mechanism includes, for example, the above mentioned male housing, the above mentioned female housing, a lock arm provided in either one of the male housing and the female housing, a lock hole formed in the other housing, and a lock ensuring member.

The lock arm has a shape of an arm extending from the one housing toward the other housing. The lock arm is provided with a projection which can be engaged with the lock hole. The lock hole passes through the above described other housing.

The lock ensuring member is supported by the one housing so as to be detachably connected to the other housing. The lock ensuring member is provided with a release preventing part which can be engaged with the lock projection.

In the conventional connector as described above, when the projection has come into engagement with the lock hole, in short, the male housing and the female housing have been engaged with each other, the lock ensuring member is pushed toward the other housing. Then, the lock ensuring member moves toward the other housing and the release preventing part is engaged with the projection. The projection will be clamped between the release preventing part and an edge of the lock hole, and thus, the male housing and the female housing will be prevented by the release preventing part from being disengaged from each other.

On the other hand, in a state where the projection is not completely engaged with the lock hole, in short, the male housing and the female housing are incompletely engaged with each other, the release preventing part is in contact with the projection, and the lock ensuring member cannot move toward the other housing.

In this manner, the connector having the conventional lock ensuring mechanism as described above determines whether or not the male housing and the female housing have been completely engaged with each other, by detecting whether or not the lock ensuring member can move toward the other housing.

In the connector having the conventional lock ensuring mechanism, the lock ensuring member has been so designed as to move toward the other housing, after the male housing and the female housing have been engaged with each other.

Moreover, since the male housing and the female housing are respectively molded of synthetic resin or the like, there has been a tendency that there are relatively large dimensional errors after the molding.

Therefore, because of the dimensional errors of the male housing and the female housing at molding, there have been such cases that the lock ensuring member can move toward the other housing, even when the male housing and the female housing have been incompletely engaged with each other. Thus, in the connector having the conventional lock ensuring mechanism, it has been impossible in some cases to determine whether or not the male housing and the female housing have been completely engaged.

In view of the above, it is an object of the present invention to provide a connector provided with a lock ensuring mechanism which can reliably detect incomplete engagement between the housings and can prevent damages due to the incomplete engagement.

SUMMARY OF THE INVENTION

In order to solve the above described problems and attain the object, according to a main aspect of the present invention, there is provided a connector with a lock ensuring mechanism which comprises a female housing for receiving terminals, a male housing for receiving terminals, a lock arm formed integrally with an outer wall of either one of the female housing and the male housing, and extended in a longitudinal direction of the terminals received in the housings, a locking part provided in the other of the female housing and the male housing, and adapted to be engaged with the lock arm, and a lock ensuring member including a release preventing part which can be engaged with the lock arm, the lock ensuring member being supported by the one housing so as to move in a longitudinal direction of the terminals between a locked position in which the release preventing part is engaged with the lock arm and an unlocked position in which the release preventing part is released from the engagement with the lock arm, wherein the lock arm includes a lock projection which projects outward and can be engaged with the locking part and the release preventing part, wherein the lock ensuring member includes a lock recess into which the lock projection is adapted to enter when the locking part and the lock projection are engaged with each other, and a flexible piece which can be elastically deformed between a restricted position in which the flexible piece is in contact with the lock projection to restrict movement of the lock ensuring member toward the other housing and a restriction released position in which the flexible piece moves apart from the lock projection narrowing the lock recess and at the same time, allows the lock ensuring member to move toward the other housing, wherein the restricted position is maintained until the lock projection has entered into the lock recess to be engaged with the locking part, and the restriction released position is attained when the lock projection has been engaged with the locking part.

According to a second aspect of the invention, at least one of the lock projection and the flexible piece is provided with a restricting face which restricts the movement of the lock ensuring mechanism toward the other housing when the lock projection has entered into the lock recess.

According to a third aspect of the invention, the restricting face is formed flat from an inside to an outside of the one housing.

According to the connector with the lock ensuring mechanism in the main aspect of the present invention, the flexible piece can be elastically deformed between the restricted position in which it is in contact with the lock projection and the restriction released position in which it moves apart from the lock projection. Therefore, a contact area between the flexible piece and the lock projection in the restricted position can be increased.

As the results, even though there have occurred large dimensional errors when molding the housings, the flexible piece and the lock projection can be reliably brought into contact in the restricted position.

In this manner, in a state where the lock projection and the locking part are not incompletely engaged, in short, the male and the female housings are incompletely engaged, the movement of the lock ensuring member toward the other housing can be reliably prevented. Therefore, by confirming whether or not the lock ensuring member can move toward the other housing, the incomplete engagement of both the housings can be reliably detected, and inconveniences caused by the incomplete engagement can be prevented beforehand.

According to the second aspect of the invention, the restricting face formed in at least one of the lock projection and the flexible piece will restrict the movement of the lock ensuring member toward the other housing in the restricted position. Therefore, in the incompletely engaged state of the housings, the movement of the lock ensuring member toward the other housing in the restricted position will be more reliably restricted.

According to the third aspect of the invention, the restricting face is formed flat from the inside to the outside of the one housing in which the lock arm is provided, and therefore, the movement of the lock ensuring member toward the other housing in the restricted position will be more reliably restricted.

DESCRIPTION OF THE PREFERRED EMBODIMENTS

Figure 1:
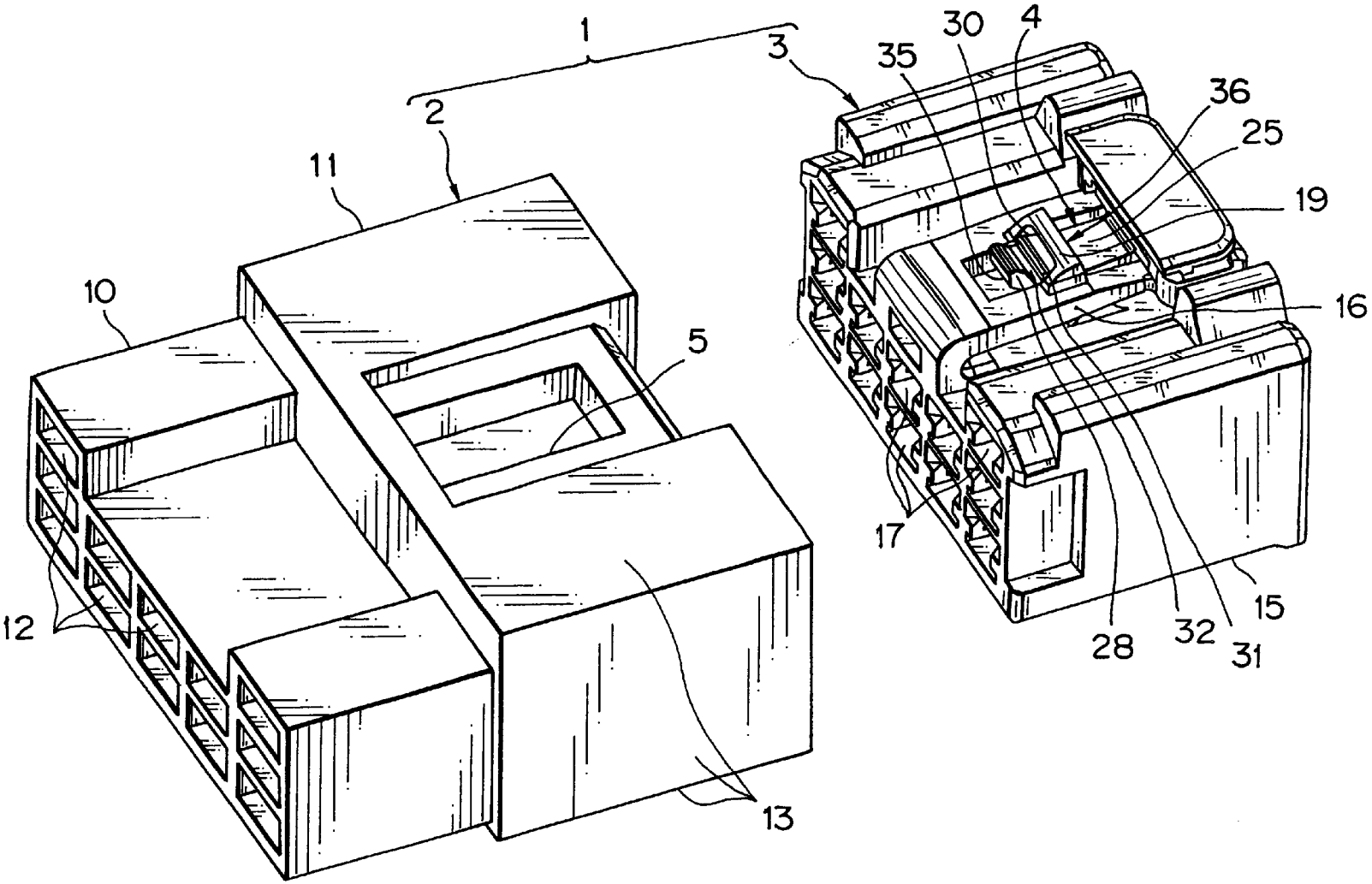
FIG. 1 is a perspective view of a connector provided with a lock ensuring mechanism according to an embodiment of the present invention as shown in an exploded state.

Now, a connector provided with a lock ensuring mechanism according to an embodiment of the present invention will be described referring to FIGS. 1 to 6. A connector 1 provided with the lock ensuring mechanism has a female housing 2 as the other housing, a male housing 3 as the one housing, and a lock ensuring member 4, as shown in FIGS. 1 to 5.

The female housing 2 includes a main body 10 formed of synthetic resin and receiving a plurality of terminals (not shown), and a case body 11 adapted to receive the male housing 3. The main body 10 has a plurality of terminal receiving chambers 12 which are arranged in parallel to each other. The terminal receiving chambers 12 extend rectilinealy and respectively receive the terminals. Locking arms for locking and fixing the terminals are omitted in the drawings.

The case body 11 is formed in a box-like shape and includes a plurality of surrounding walls 13 which are respectively continued to outer edges of the main body 10. In short, the case body 11 is integral with the main body 10. Edges of the surrounding walls 13 remote from the main body 10 constitute an opening for receiving the male housing 3.

One of the surrounding walls 13 of the case body 11 located in an upper side in the drawings is provided with a lock hole 5 which passes through the relevant surrounding wall 13. The lock hole 5 is formed at the center in a lateral direction of the surrounding wall 13 and along a direction in which the main body 10 and the case body 11 are continued to each other. A lock projection 36 of a lock arm 16 which will be described below is adapted to be engaged with the lock hole 5.

The male housing 3 is formed of synthetic resin and includes a main body 15 which receives a plurality of terminals (not shown), and the aforesaid lock arm 16, as shown in FIGS. 1 to 5. The main body 15 has a plurality of terminal receiving chambers 17 which are arranged in parallel to each other. The terminal receiving chambers 17 extend rectilinealy and respectively have locking arms 18 for locking the above described terminals, as shown in FIGS. 2 to 5. The terminal receiving chambers 17 respectively receive the aforesaid terminals metals. The main body 15 is inserted into the case body 11 so that the terminal receiving chambers 17 and the terminal receiving chambers 12 of the female housing 2 may communicate with each other.

The lock arm 16 is formed in a bar-like shape, and has its one end continued to an edge of the main body 15 of the male housing 3 close to the case body 11. In other words, the lock arm 16 is integral with an outer wall of the male housing 3. The other end of the lock arm 16 is free, so that the lock arm 16 is supported by the main body 15 in a cantilever manner. A longitudinal direction of the lock arm 16 is arranged in a direction in which the housings 2 and 3 approach each other when they are engaged with each other. This means that the lock arm 16 is along a longitudinal direction of the terminals which are received in both the female housing 2 and the male housing 3. The lock arm 16 has elasticity, and can be elastically deformed so that the other end thereof is projected and retracted from an outer wall of the main body 15.

Figure 2:
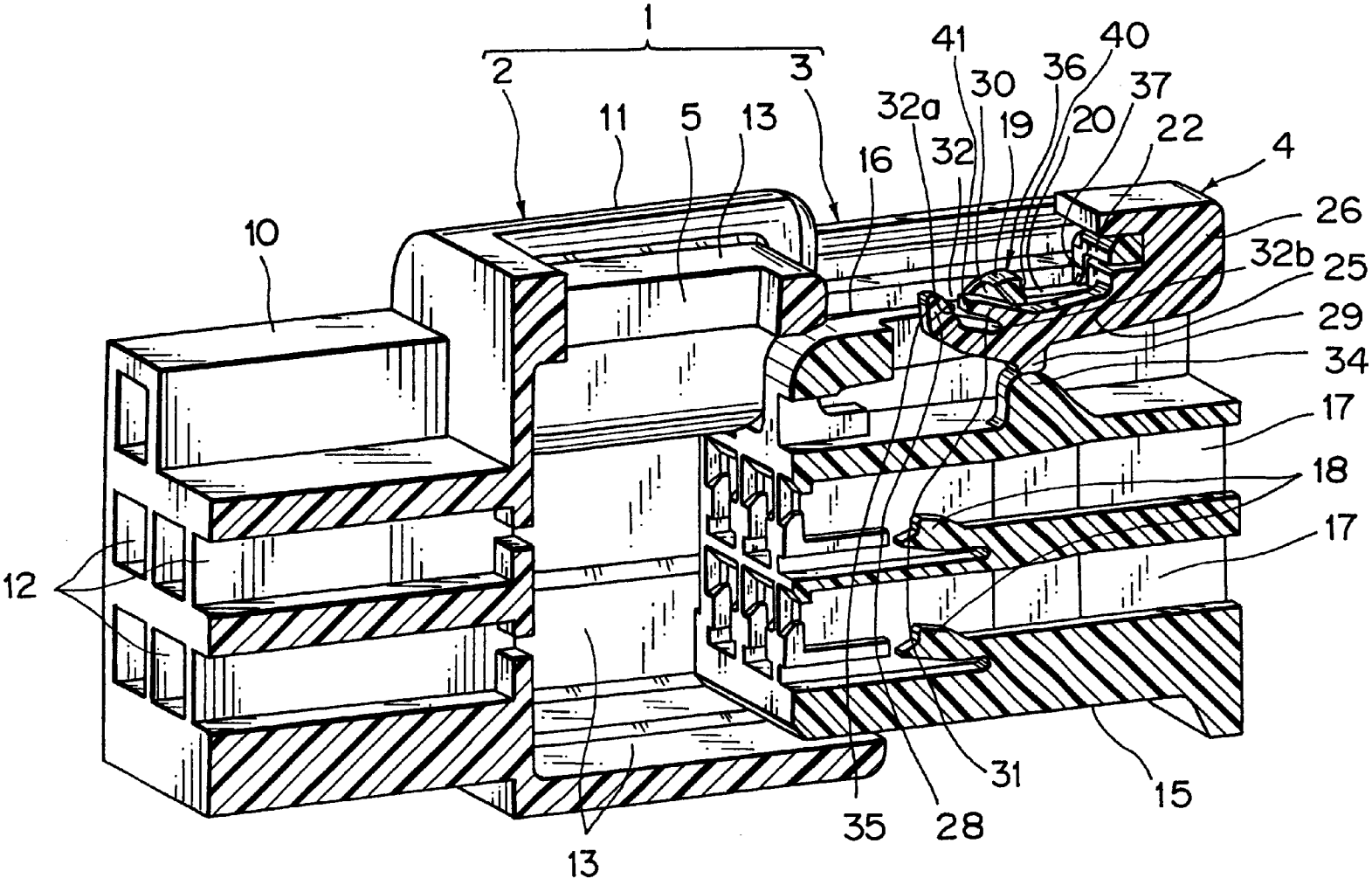
FIG. 2 is a perspective view showing in section a state wherein a male housing of the above embodiment has started to be inserted into a female housing.
Figure 3:
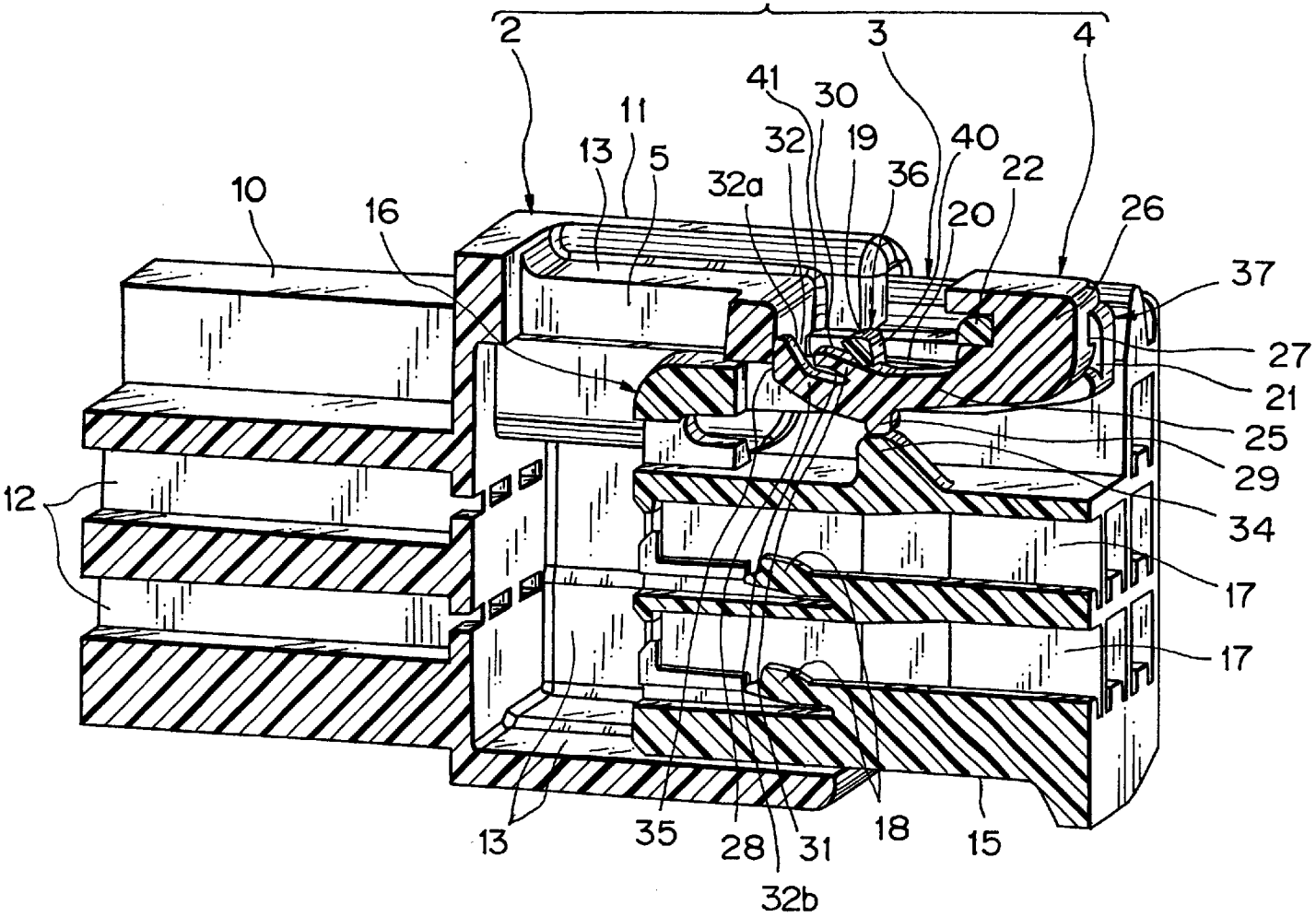
FIG. 3 is a perspective view showing in section a state wherein a contact face of the lock ensuring member has come into contact with a surrounding wall of the female housing of the above embodiment.
Figure 4:
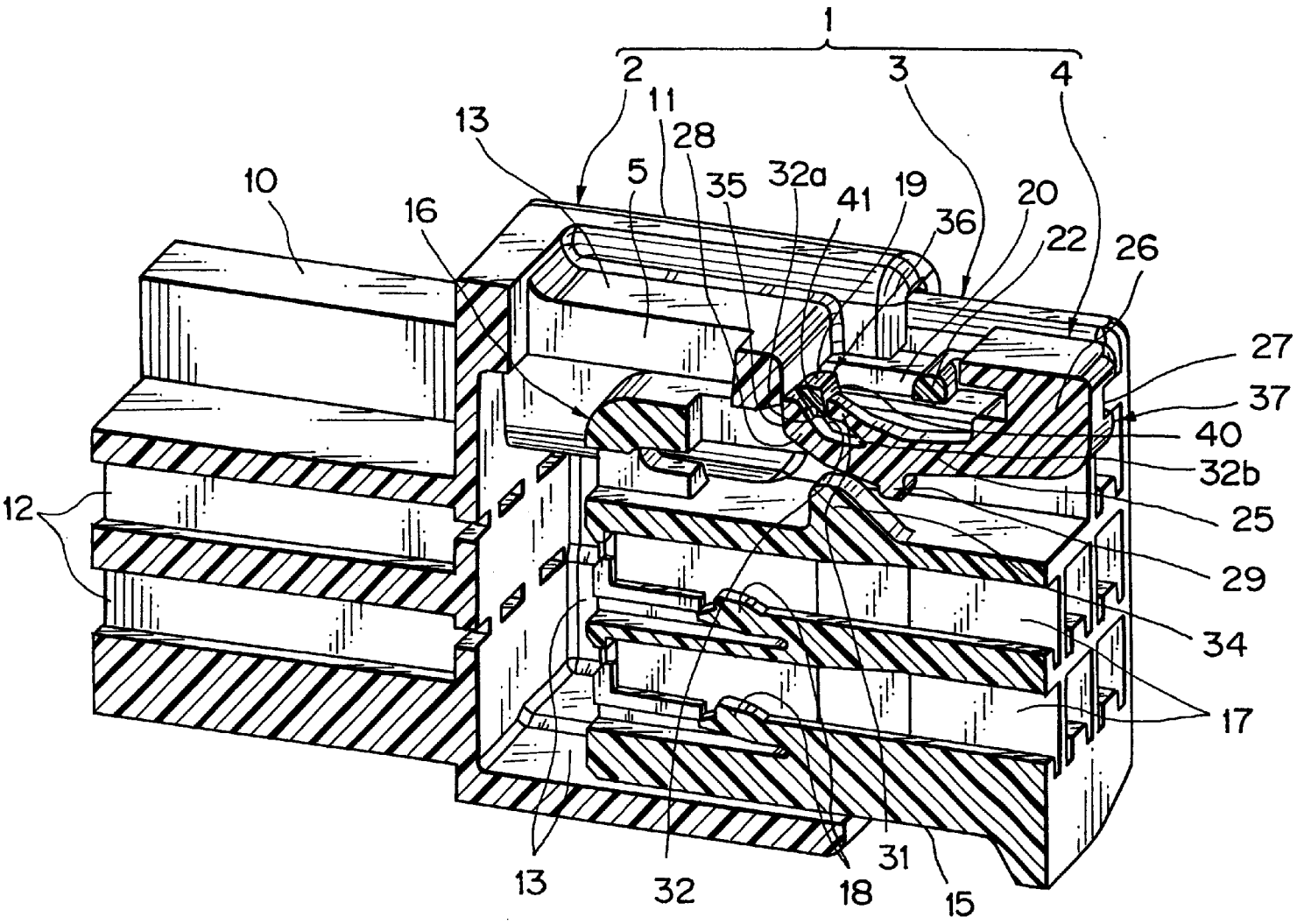
FIG. 4 is a perspective view showing in section a state wherein the lock ensuring member is pushed by the female housing of the above embodiment so as to move away from the female housing.
Figure 5:
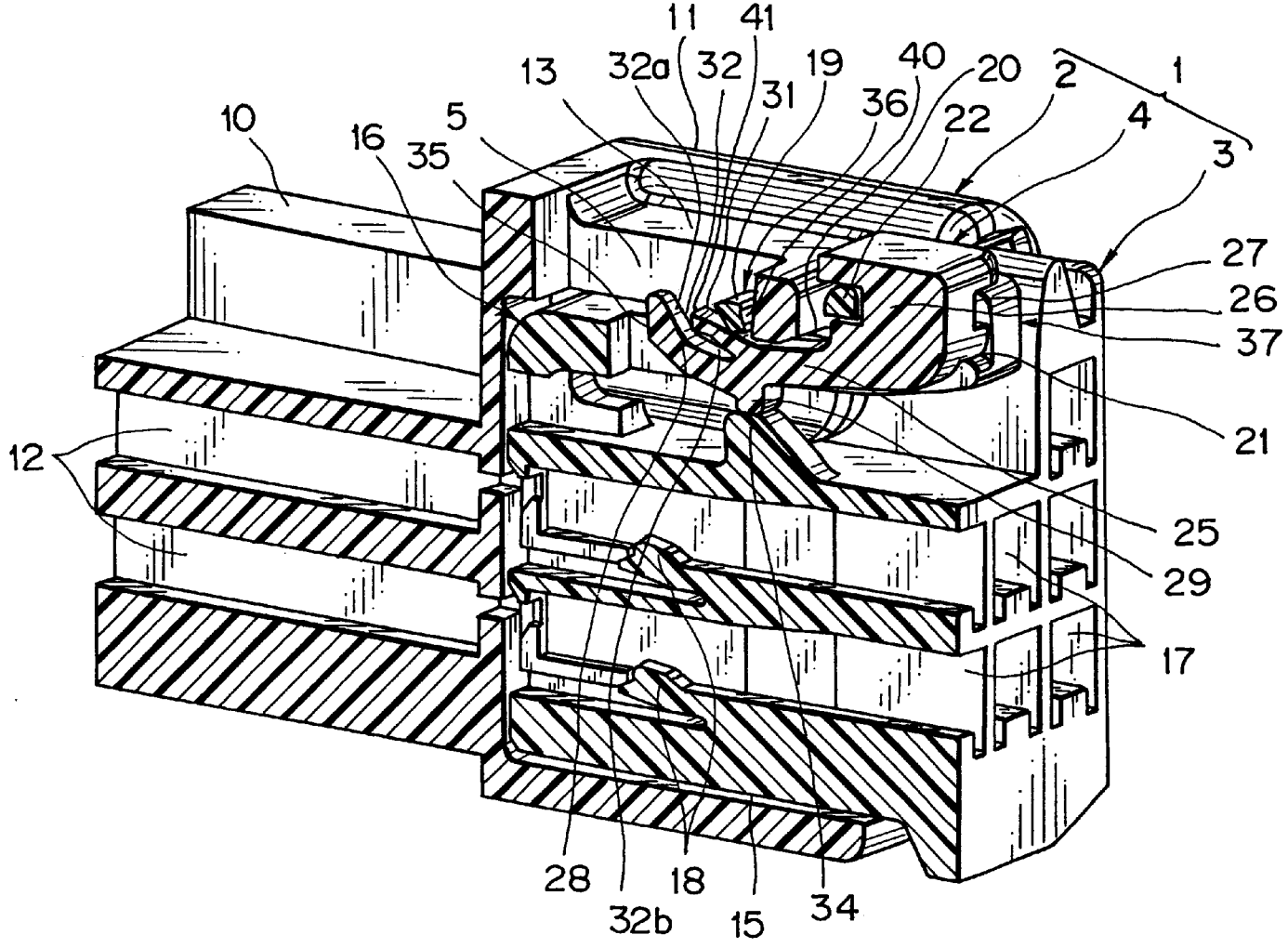
FIG. 5 is a perspective view showing in section a state wherein the male housing and the female housing of the above embodiment have been engaged with each other.

The lock arm 16 is provided with a lock projection 36, as shown in FIGS. 1 to 5, at the center in its longitudinal direction, and a support part 37, as shown in FIGS. 3 to 5, which extends from the center to the aforesaid other end. The lock projection 36 projects from a surface of the lock arm 16 outward of the male housing 3. The lock projection 36 is adapted to enter into the lock hole 5 of the female housing 2 and to be engaged with the lock hole 5. This means that the lock arm 16 can be engaged with the lock hole 5. The lock projection 36 is formed with a groove 20 which will be described below, along the lateral direction of the lock arm 16.

The lock projection 36 has an inclined face 19, a through hole 30 and a restricting face 40. The inclined face 19 is faced with the female housing 2, when the male housing 3 is engaged with the female housing 2. The inclined face 19 is gradually inclined toward an interior of the male housing 3, as the housings 2 and 3 approach each other, with respect to the direction in which the housings 2 and 3 approach each other. An edge of the case body 11 of the female housing 2 will be abutted against the inclined face 19, when the male housing 3 comes into engagement with the female housing 2.

The through hole 30 passes through an end part of the lock projection 36 close to the female housing 2 and is communicated with the groove 20. The restricting face 40 is defined at an end face of the lock projection 36 which is remotest from the female housing 2. The restricting face 40 is formed flat from the inside toward the outside of the male housing 3. The restricting face 40 is perpendicular to the direction in which the housings 2 and 3 approach each other when they are engaged.

As shown in FIG. 3, the support part 37 has the support groove 20, a guide part 21 and a stopper 22. The support groove 20 is formed at the center in the lateral direction of the lock arm 16, and passes through the lock arm 16 from the aforesaid other end to the center. A member body 25 of a lock ensuring member 4 which will be described below is adapted to pass through the support groove 20.

The guide part 21 is formed at the other end of the lock arm 16 as shown in FIG. 3, and provided with a guide projection (not shown) which is adapted to enter into a guide groove 27 in a base part 26 of the lock ensuring member 4, which will be described below. The guide projection extends in the direction in which the housings 2 and 3 approach each other, and supports.the base part 26 so as to move along a direction in which the housings 2 and 3 are detached from each other. In other words, the support part 37 supports the lock ensuring member 4 so as to move in a longitudinal direction of the terminals which are received in the housings 2 and 3.

The stopper 22 is provided at the other end of the lock arm 16, and adapted to get into contact with the base part 26 of the lock ensuring member 4 which has been moved toward the female housing 2. Thus, in contact with the base part 26, the stopper 22 will prevent the lock ensuring member 4 which has been moved toward the female housing 2 from being removed out of the support part 37. In other words, the stopper 22 restricts a position of the lock ensuring member 4 close to the female housing 2.

The lock ensuring member 4 has a member body 25 in an arm-like shape, a release preventing part 28, a projection 29, and the aforesaid base part 26, as shown in FIGS. 1 to 5. The member body 25 is disposed in the support groove 20 of the lock arm 16 with its longitudinal direction aligned with the direction in which the housings 2 and 3 approach each other. The member body 25 has elasticity, and can be elastically deformed so that the release preventing part 28 is displaced from an inside to an outside of the male housing 3, and from the inside to the outside.

The release preventing part 28 is provided at an end of the member body 25 close to the female housing 2. When the base part 26 has come into contact with the stopper 22, the release preventing part 28 projects from an outer face of the lock arm 16 outward of the male housing 3 through the support groove 20 and the through hole 30. When the base part 26 has come into contact with the stopper 22, the release preventing part 28 is located more close to the female housing 2 than the lock projection 36. This state is referred to as "a locked position" in the claims in which the release preventing part 28 is engaged with the lock projection 36, that is, the lock arm 16.

At the locked position, the release preventing part 28 is engaged with the lock projection 36, that is, the lock arm 16. In a state where the lock projection 36 has been engaged with the lock hole 5, in other words, the housings 2, 3 have been engaged with each other, the projection 36 is clamped between the release preventing part 28 and an inner edge of the lock hole 5 in the locked position of the release preventing part 28, as shown in FIG. 5. By thus clamping the lock projection 36 in cooperation with the inner edge of the lock hole 5 in the locked position, the release preventing part 28 prevents the male housing 3 from being detached out of the case body 11 of the female housing 2.

The release preventing part 28 has a lock recess 32, a flexible piece 31, and a contact face 35. The lock recess 32 is dented from a surface of the release preventing part 28 which is located outside of the male housing 3. The lock recess 32 consists of a vertically extending portion 32*a* and a horizontally extending portion 32*b*.

The vertically extending portion 32*a* is dented from the surface of the release preventing part 28, and extends from the surface of the release preventing part 28 toward an inside of the male housing 3. The horizontally extending portion 32*b* is continued from the vertically extending portion 32*a* and extends from the end of the vertically extending portion 32*a* toward the base part 26 in a longitudinal direction of the member body 25.

When the lock ensuring member 4 has moved in a direction away from the female housing 2, the lock projection 36 enters into the lock recess 32, especially in the vertically extending portion 32*a*. The lock projection 36 enters into the lock recess 32, when the lock projection 36 is engaged with the lock hole 5. A position in which the lock projection 36 has entered into the lock recess 32 is referred to as "an unlocked position" in the claims.

In this unlocked position, the release preventing part 28 is disengaged from the lock projection 36, that is, the lock arm 16. As described, the lock ensuring member 4 is supported by the male housing 3 so as to move between the locked position and the unlocked position.

The flexible piece 31 is provided between the lock recess 32 and the base part 26, defining an inner edge of the lock recess 32 close to the base part 26. The flexible piece 31 has a restricting face 41 adapted to be faced with the restricting face 40 of the lock projection 36, when the lock projection 36 has entered into the lock recess 32. The restricting face 41 is formed flat from the inside toward the outside of the male housing 3, and perpendicular to the direction in which the housings 2 and 3 approach each other when they are engaged.

In the aforesaid locked position, the flexible piece 31 projects outward of the housing 3 from the outer surface of the lock arm 16 through the through hole 30. A position in which the flexible piece 31 projects outward of the housing 3 from the outer surface of the lock arm 16 is referred to as "a restricted position" in the claims.

When the lock projection 36 has entered into the lock recess 32 in this restricted position, the restricting face 41 is opposed to the restricting face 40 of the lock projection 36. In this restricted position, the restricting faces 40 and 41 come into contact with each other, and the lock ensuring member 4 cannot move toward the female housing 2, even though the lock ensuring member 4 is forced to move toward the female housing 2. In this manner, the flexible piece 31 is in contact with the lock projection 36 in the restricted position, and the movement of the lock ensuring member 4 toward the female housing 2 will be restricted.

The flexible piece 31 can be deformed from the aforesaid restricted position in such a manner that the lock recess 32, especially its horizontally extending portion 32*b* is narrowed, until a surface of the flexible piece 31 has become flush with the outer surface of the lock arm 16. The position in which the surface of the flexible piece 31 is flush with the outer surface of the lock arm 16 is referred to as "a restriction released position" in the claims.

In the restriction released position, because the surface of the flexible piece 31 is flush with the outer surface of the lock arm 16, the restricting faces 40 and 41 are not opposed to each other. When the lock ensuring member 4 is moved toward the female housing 2 in the restriction released position, the restricting faces 40 and 41 are not contacted with each other, and the lock ensuring member 4 can move toward the female housing 2. In this manner, the flexible piece 31 moves apart from the lock projection 36 narrowing the horizontally extending portion 32*b*, and thus enables the lock ensuring member 4 to move toward the female housing 2.

The contact face 35 is defined at an end face of the release preventing part 28 which is closest to the female housing 2. In the locked position, the contact face 35 projects from the outer face of the lock arm 16 outward of the male housing 3, and comes into contact with an edge of the case body 11 of the female housing 2. In other words, the contact face 35 can be abutted against the female housing 2 when the release preventing part 2.8 is engaged with the lock projection 36, that is, the lock arm 16.

The projection 29 projects from a middle part of the member body 25 in a longitudinal direction inward of the male housing 3. The base part 26 is formed at the other end of the member body 25 remote from the female housing 2. The base part 26 is provided with a guide groove 27 which extends in a direction in which the housings 2, 3 approach each other. The aforesaid guide projection is adapted to enter into the guide groove 27.

When the guide projection has entered into the guide groove 27, the base part 26 is supported by the male housing 3 in such a manner that it can move in a direction in which the housings 2, 3 approach and are away from each other. In the locked position of the lock ensuring member 4, the base part 26 is retreated from an outer wall of the main body 15 which is the remotest from the female housing 2, as shown in FIGS. 3 and 5.

In the unlocked position of the lock ensuring member 4, the base part 26 is flush with the outer wall of the main body which is the remotest from the female housing 2, or a little behind the outer wall, as shown in FIG. 4. In this manner, the base part 26 will not project from the outer wall of the male housing 3, while the lock ensuring member 4 moves between the locked position and the unlocked position.

The male housing 3 is further provided with a restricting projection 34 which projects from a wall face of the main body 15 located at a bottom of the support groove 20. In the locked position of the lock ensuring member 4, the restricting projection 34 comes into contact with the projection 29. The restricting projection 34 will maintain the release preventing part 28 in a projected state outward of the male housing 3, when it has come into contact with the projection 29.

In other words, when the restricting projection 34 has come into contact with the projection 29, it prevents the release preventing part 28 from moving away from the lock projection 36. The restricting projection 34 will not disturb the aforesaid movement of the lock ensuring member 4 between the locked position and the unlocked position.

Prior to the engagement of the female housing 2 with the male housing 3 having the above described structures, the lock ensuring member 4 is in the aforesaid locked position and engaged with the lock projection 36.

Figure 6A:
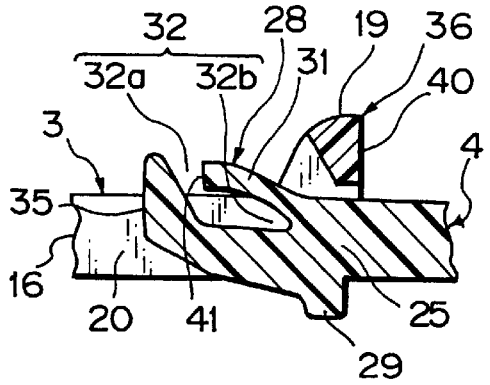
FIGS. 6A to 6E are explanatory views showing processes in which the male housing and the female housing of the above embodiment are engaged with each other, with their essential parts enlarged.
Figure 6B:
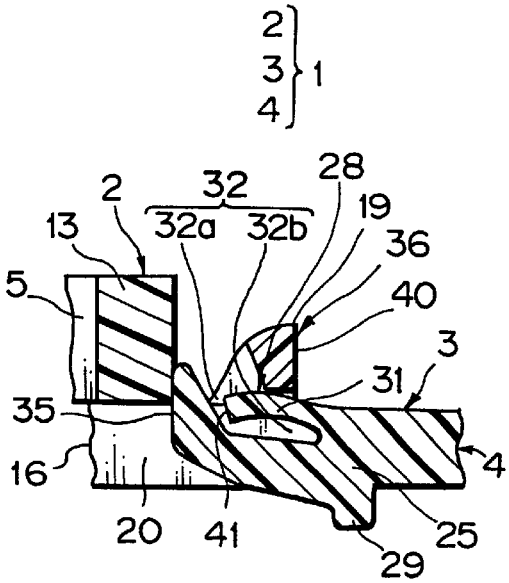

In order to engage the female housing 2 and the male housing 3 with each other, the opening of the case body 11 and the openings of the terminal receiving chambers 17 are first allowed to be faced with each other, as shown in FIG. 1. On this occasion, the release preventing part 28 is in the locked position in which it has been engaged with the lock projection 36, as shown in FIG. 6A. As the male housing 3 is gradually inserted into the case body 11 as shown in FIG. 2, the contact face 35 comes into contact with an edge of one of the surrounding walls 13 of the male housing 2, as shown in FIGS. 3 and 6B.

As the male housing 3 is further introduced into the case body 11, the lock ensuring member 4 is pushed by the edge of the one surrounding wall 13, namely the male housing 2, and detached from the male housing 2. At the same time, the flexible piece 31 is pushed by the lock projection 36 and elastically deformed so as to narrow the horizontally extending portion 32*b* as shown in FIG. 6B.

Figure 6C:
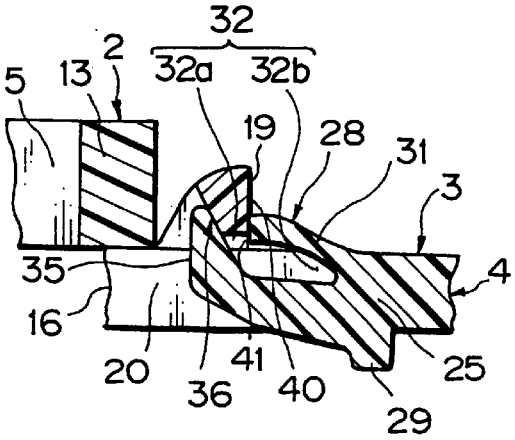

Thereafter, as shown in FIGS. 4 and 6C, the lock projection 36 enters into the lock recess 32, and the release preventing part 28 will be positioned in the unlocked position. The flexible piece 31 will continue to be in the restricted position, until the lock projection 36 is engaged with the lock hole 5 in the female housing 2. As the male housing 3 is gradually introduced into the case body 11, the surrounding wall rides on the inclined face 19 of the lock projection 36. Then, the lock arm 16 is elastically deformed so that the lock projection 36 may be guided along the inclined face 19 to be positioned underneath the aforesaid one surrounding wall 13.

Then, the lock projection 36 enters into the lock hole 5. When the lock projection 36 has entered into the lock hole 5, the lock projection 36 will be displaced from underneath of the aforesaid one surrounding wall 13 outward of the male housing 3 by elastic restoring force of the lock arm 16, thereby to be locked with the lock hole 5.

Figure 6D:
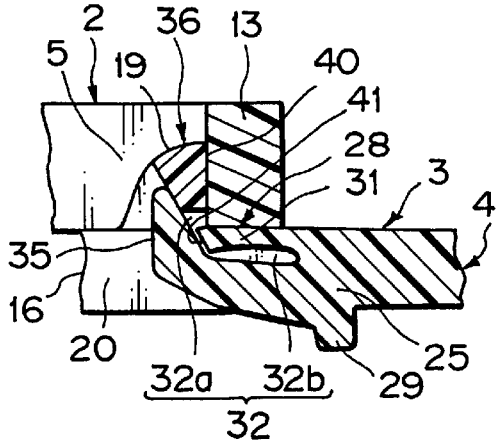

When the lock projection 36 has come into engagement with the lock hole 5, the flexible piece 31 is located underneath the aforesaid one surrounding wall 13, as shown in FIG. 6D. On this occasion, the flexible piece 31 is in the restriction released position in which the lock arm 16 is flush with the outer surface of the lock arm 16.

Figure 6E:
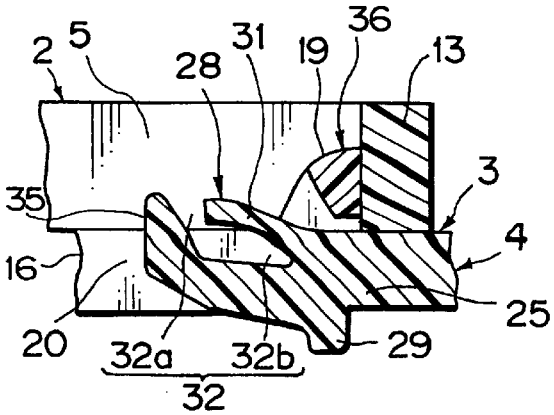

The lock ensuring member 4 is moved toward the female housing 2. On this occasion, because the restricting faces 40, 41 are not faced with each other, the lock ensuring member 4 can be moved toward the female housing 2. The lock projection 36 will be clamped between the release preventing part 28 and the inner edge of the lock hole 5 by elastic restoring force of the member body 25 of the lock ensuring member 4, as shown in FIG. 6E. Thus, the release preventing part 28 is engaged with the lock arm 16, and comes into the locked position. In this manner, the female housing 2 and the male housing 3 are engaged with each other.

In the incompletely engaged state of the female housing 2 and the male housing 3, that is, in a state where the lock projection 36is not engaged with the lock hole 5, for the reason that the lock projection 36 is located underneath the one surrounding wall 13 or for other reasons, the flexible piece 31 is located in the restricted position in which it projects from the surface of the lock arm 16.

Consequently, the restricting faces 40, 41 will strike each other, and the lock ensuring member 4 cannot move into the locked position. By confirming whether or not the lock ensuring member 4 can move toward the locked position in this manner, whether or not the housings 2, 3 have been accurately engaged with each other can be grasped.

In the completely engaged state of the housings 2, 3, the projection 29 of the lock ensuring member 4 and the restricting projection 34 are in contact with each other. The restricting projection 34 prevents the member body 25 from being deformed so as not to be disengaged from the lock arm 16. Accordingly, the release preventing part 28 is kept locked with the lock arm 16, even though the housings 2, 3 are forced to be detached from each other, in their completely engaged state. In this manner, the housings 2, 3 which have been completely engaged will never be disengaged from each other by accident.

On the other hand, when the lock ensuring member 4 located in the locked position is moved in a direction away from the female housing 2 in the completely engaged state of the housings 2, 3, the restricting projection 34 will not hinder the movement of the lock ensuring member 4. Consequently, the lock ensuring member 4 can be smoothly moved to the unlocked position, and engagement of the release preventing part 28 with the lock arm 16 can be disengaged. Thus, the housings 2, 3 can be easily detached from each other.

According to this embodiment, the flexible piece 31 can be elastically deformed between the restricted position in which it is projected from the outer face of the lock arm 16 and the restriction released position in which it is flush with the lock arm 16. Therefore, a contact area at which the restricting faces 40, 41 are in contact with each other can be made larger in the aforesaid restricted position.

As the results, even though a large dimensional error has occurred when molding the housings 2, 3, the lock projection 36 and the flexible piece 31 are allowed to reliably come into contact with each other. Thus, in the incompletely engaged state of the housings 2, 3, movement of the lock ensuring member 4 toward the female housing 2 can be reliably prevented.

Therefore, by confirming whether or not the lock ensuring member 4 can move toward the female housing 2, the incomplete engagement of the housings 2, 3 can be reliably detected, and inconveniences caused by the incomplete engagement can be prevented beforehand.

Moreover, the restricting faces 40, 41 are perpendicular to the direction in which the housings 2, 3 approach each other. When these restricting faces 40, 41 have come into contact with each other, the movement of the lock ensuring member 4 toward the female housing 2 can be reliably prevented. Thus, in the incompletely engaged state of the housings 2, 3, the movement of the lock ensuring member 4 toward the female housing 2 can be more reliably prevented.

In the above described embodiment, the lock hole 5 is provided in the female housing 2, while the lock ensuring member 4 and the lock projection 36 are provided in the male housing 3. However, the present invention is not limited to this embodiment, but it is apparent that the lock hole 5 may be provided in the male housing 3, and the lock ensuring member 4 and the lock projection 36 may be provided in the female housing 2.

Although the present invention has been fully described by way of examples with reference to the accompanying drawings, it is to be noted that various changes and modifications can be made within the scope of the present invention.

What is claimed is:

1. A connector with a lock ensuring mechanism comprising;

a female housing for receiving terminals;

a male housing for receiving mating terminals;

a lock arm formed integrally with an outer wall of either one of said female housing and said male housing, and extended in a longitudinal direction of said terminals received in said housings;

a locking part provided in the other of said female housing and said male housing, and adapted to be engaged with said lock arm; and a lock ensuring member including a release preventing part which can be engaged with said lock arm, said lock ensuring member being supported by said one housing so as to move in a longitudinal direction of said terminals between a locked position in which said release preventing part is engaged with said lock arm and an unlocked position in which said release preventing part is released from the engagement with said lock arm, wherein said lock arm includes a lock projection which projects outward and can be engaged with said locking part and said release preventing part, wherein said lock ensuring member includes a lock recess into which said lock projection is adapted to enter when said locking part and said lock projection are engaged with each other, and a flexible piece which can be elastically deformed between a restricted position in which said flexible piece is in contact with said lock projection to restrict movement of said lock ensuring member toward said other housing and a restriction released position in which said flexible piece moves apart from said lock projection narrowing said lock recess and at the same time, allows said lock ensuring member to move toward said other housing, wherein said restricted position is maintained until said lock projection has entered into said lock recess to be engaged with said locking part, and said restriction released position is attained when said lock projection has been engaged with said locking part.

2. The connector with the lock ensuring mechanism as claimed in claim 1, wherein at least one of said lock projection and said flexible piece is provided with a restricting face which restricts the movement of said lock ensuring mechanism toward said other housing when said lock projection has entered into said lock recess.

3. The connector with the lock ensuring mechanism as claimed in claim 2, wherein said restricting face is formed flat from an inside to an outside of said one housing.

* * * * *